US005430945A

United States Patent [19]

Huang

[11] Patent Number: 5,430,945

[45] Date of Patent: Jul. 11, 1995

[54] MANUALLY PIVOTABLE MAGNETIC UNIT ON A CAN OPENER FOR HOLDING AND RELEASING THE CUT LID OF A CAN

[76] Inventor: Xiang-Dong Huang, 43-24 195 St., Flushing, N.Y. 11358

[21] Appl. No.: 103,701

[22] Filed: Aug. 10, 1993

[51] Int. Cl.[6] ..... B67B 7/72

[52] U.S. Cl. ..... 30/410; 30/416; 30/426; 294/65.5

[58] Field of Search ..... 30/410, 409, 416–427, 30/433–436, 442; 294/65.5

[56] References Cited

U.S. PATENT DOCUMENTS

| | | | |
|---|---|---|---|
| 2,503,467 | 4/1950 | Blind | 294/65.5 |
| 2,554,628 | 5/1951 | Mesik | 30/410 |
| 2,749,612 | 6/1956 | Blue | 30/442 |
| 2,828,762 | 4/1958 | Swank | 294/65.5 X |
| 2,976,075 | 3/1961 | Budreck | 294/65.5 |
| 3,079,683 | 3/1963 | Carew et al. | 30/410 X |
| 3,080,078 | 3/1963 | Carew et al. | 30/410 X |
| 3,156,979 | 11/1964 | Hafstrom et al. | 30/410 X |
| 3,307,256 | 3/1967 | Powers | 30/410 |

FOREIGN PATENT DOCUMENTS

| | | | |
|---|---|---|---|
| 505142 | 8/1951 | Belgium | 294/65.5 |
| 542524 | 6/1957 | Canada | 294/65.5 |
| 740560 | 1/1933 | France | 294/65.5 |
| 738193 | 10/1955 | United Kingdom | 294/65.5 |

*Primary Examiner*—Richard K. Seidel
*Assistant Examiner*—Clark F. Dexter

[57] ABSTRACT

The invention is a unit that is attachable to a side face of a handle of a can opener, which unit is manually operable to engage a magnet upon the lid of a can so as to magnetically hold the lid from dropping into the contents of the can as it is cut away, and which unit is manually operable, upon the lid being cut away, to effect at the will of the user release of the hold of the magnet from the lid so as to allow the cut lid to drop for disposal from the unit and the can opener. In making use of the unit embodying the invention, the user avoids manually touching the cut lid, and in doing so he avoids soiling his fingers with the contents of the can, and avoids cutting his fingers upon the sharp edges of the cut lid.

5 Claims, 1 Drawing Sheet

MANUALLY PIVOTABLE MAGNETIC UNIT ON A CAN OPENER FOR HOLDING AND RELEASING THE CUT LID OF A CAN

BACKGROUND OF THE INVENTION

This invention is directed to providing a butterfly-handled can opener with a magnetic unit that is manually pivotable in one direction to hold the lid of a can as it is being cut away, and is manually pivotable in an opposite direction for subsequently releasing the cut lid from the unit.

Butterfly-handled can openers are present in many households for cutting the lid from a can. A common type serves only to cut the lid from the can. Often in its use the cut lid drops into the contents of the can. In removing the lid a person's fingers are not only soiled but may also be cut by the sharp edges of the cut lid.

In an effort to avoid dropping of the cut lid into the contents of the can a magnet has been added to some can openers to hold the cut lid as it is being cut away. This form of the can opener, without more, also has its undesirable faults. The hold of the magnet upon the cut lid requires a person to manually pull the cut lid from the magnet for disposal. In doing so, a person's hand may not only be soiled by some contents of the can at the underside of the lid but may also be cut by the sharp edges of the cut lid.

A can opener provided with a unit embodying the present invention does not have the foregoing faults, as at no time in the use of the can opener will the cut lid drop into the contents of the can, and at no time is the user required to manually touch the cut lid to effect its removal from the can opener for disposal. Accordingly, the user's fingers will not become soiled with the contents of the can, nor will they be subject to being cut by the sharp edges of the cut lid.

BRIEF SUMMARY OF THE INVENTION

In accordance with the invention there is provided for a conventional butterfly-handled can opener a unit embodying the invention. The unit is adapted to be mounted to a side face of the upper handle of the can opener. The unit, as mounted, has an arm which is fixed at its rear to the handle and is offset away from the handle so as to position a vertically depending open-ended cylinder at its outer end above the lid of the can to be cut. The unit also includes a lever which is manually pivotable in one direction to move a magnet through the cylinder to engage and hold the lid of the can as the lid is being cut; and which lever is subsequently pivotable in a reverse direction to raise the cut lid into abutment with the bottom end of the cylinder so as to cause the cut lid to drop free of the magnet as the magnet is raised further into the cylinder out of contact with the cut lid. Apart from the magnet, the unit is made of non-magnetic material, such as aluminum, or plastic.

DETAILED DESCRIPTION OF THE INVENTION

Figure 1:
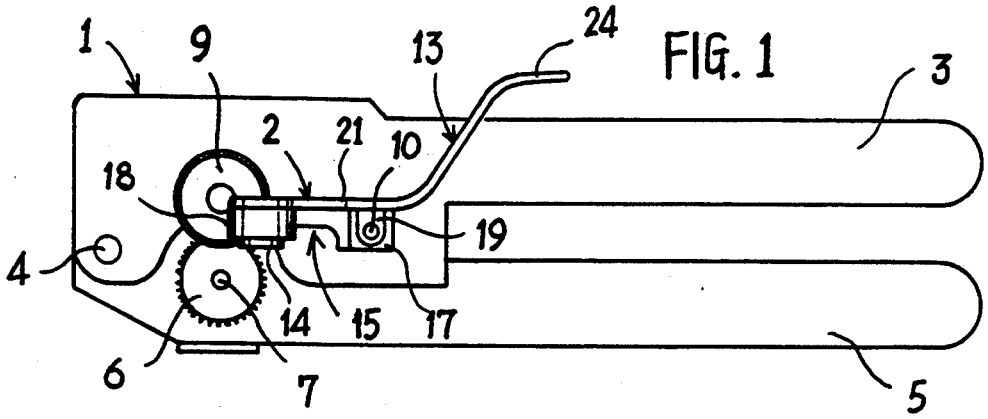
FIG. 1 is a side elevational view of a conventional butterfly-handled can opener to a side face of which a unit embodying the invention has been attached.
Figure 2:
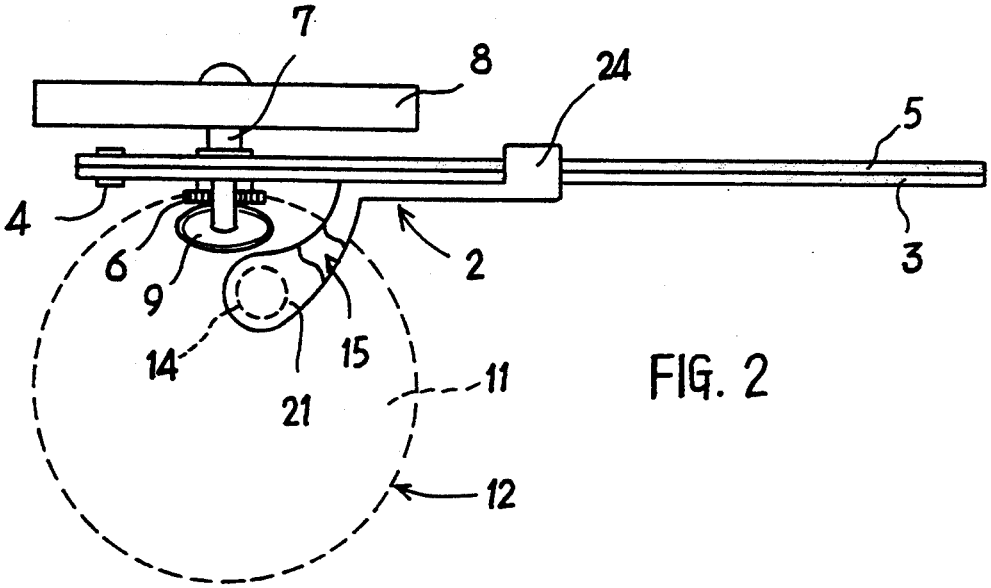
FIG. 2 is a top plan view of FIG. 1, showing in broken line the lid of a can to be cut away, and showing the magnet end of the unit over the lid.

The invention will now be described with reference to the accompanying drawing, sufficiently and in such concise manner as to enable persons having ordinary skill in the art to understand and use the same.

The can opener 1 shown in the drawing to which a unit 2 embodying the invention has been mounted is a butterfly-handled can opener of a conventional type. It has a flat side faced upper handle 3 pivoted at its forward end 4 to a flat side faced lover handle 5. The lower handle has a gear 6 mounted upon a stub shaft 7 which projects through the opposite side of the handle and has mounted upon its end a butterfly 8. Manual turning of the butterfly serves to rotate the gear. Mounted upon the inner side face of the upper handle 3 above the gear 6 is a cutter wheel 9. The can opener is operable in conventional manner. The rim of a lid 11 to be cut from a can 12 is caused to be gripped by the handles 3, 5 between the gear and the cutter wheel, and the butterfly 8 is manually turned to effect rotation of the can by the gear and cutting of the lid from the can by the cutter wheel.

Without the unit 2 embodying the invention attached to the can opener, the lid upon being cut away would drop free of the can with the accompanying faults, as earlier described. The function of the unit is to effect a magnetic hold upon the lid of the can as it is being cut away, and for subsequently effecting removal of the cut lid from the hold of the magnet, without the user of the can opener manually touching the cut lid at anytime.

The unit 2 is mounted to the inner side face of the upper handle 3 of the can opener. The unit includes a lever 13 which is manually pivotable in a forward direction to move a magnet 14 at its outer end to magnetically engage a flat surfaced bottom end of the magnet into holding engagement with the lid of the can to be cut; and the unit includes a stationary member 15 below the lever, which member cooperates with the lever, upon pivoting of the lever in an opposite direction, to effect disengagement of the magnet from the lid of the can.

The stationary member 15 is in the form of an arm having at its rear end a depending flat surfaced backpiece 17 which is fixed in suitable manner, as by rivet 10 or a strong adhesive, to the inner side face of the upper handle 3 of the can opener. The arm 15 is offset so as to extend away from the backpiece and the face of the handle; and the arm terminates at its outer end in a vertically depending open-ended cylinder 18, which is positioned by the offset arm so as to overhang the lid 11 of a can engaged by the can opener.

The lever 13 has intermediately of its ends a depending flat surfaced vertical ear 19 which is pivoted for relative movement to the backpiece 17 of the stationary arm 15. A section 21 of the lever extends forwardly from the ear 19 and is offset, in the manner of the lower arm 15, from the ear 19 and the inner face of the upper handle 3. The forward section 21 of the lever overlies the arm 15, and it has fixed to its outer end the vertically depending cylindrical magnet 14. The magnet depends freely into the open-ended cylinder 18 of the stationary arm 15. A section of the lever 13 extending rearwardly from the pivoted ear 19 rises above the upper edge of the handle 3 and terminates in a finger engageable nub 24.

Figure 4:
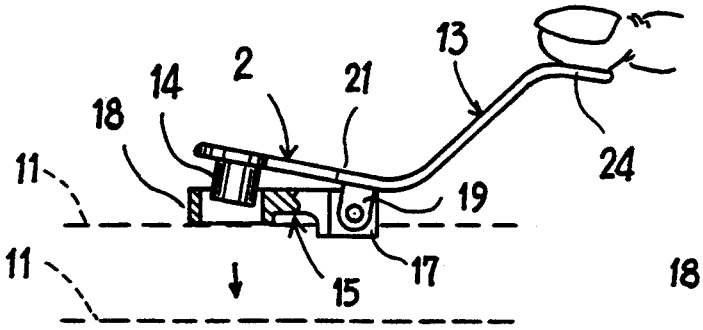
FIG. 4 is an enlarged side view of the unit embodying the invention apart from the can opener; it shows the magnet to have been raised upward by a clockwise pivoting of an attached lever; and shows the cut lid, which had been raised into abutment with the bottom of the cylinder of the stationary member by the pivoting action, to have dropped free of the magnet as the magnet was raised out of contact with the cut lid, the cut lid being shown in broken line in abutment with the cylinder, and as dropped from the magnet.
Figure 3:
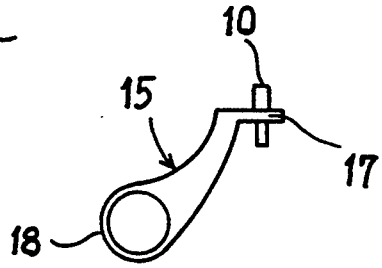
FIG. 3 is a detail top view of the stationary lower member of the unit.

The lever has a normal condition is which its forward section 21 is pivoted downward upon the arm 15, and the magnet 14 at the end of the section is fully entered into the cylinder 18 of the arm 15 and projects from the bottom of the cylinder, as appears in FIG. 1, preferably for approximately one-eighth of an inch. When the lever is pivoted in an opposite direction, the magnet is drawn into the cylinder clear of and above the bottom end of the cylinder, as appears in FIG. 4.

As earlier mentioned, the unit 2, except for the magnet, is made of non-magnetic material, such as aluminum or plastic.

In an application of a can opener, embodying the unit 2, to engage and cut the lid fully from the top of a can, the rim of the can is positioned in conventional manner between the gear 6 and the cutter wheel 9. In this position of the can, the flat faced bottom end of the protruding magnet presses upon and magnetically engages the lid of the can. The handles 3, 5 are then manually gripped and pressed toward each other to cause the cutter wheel to cut into the lid of the can. While the handles are held in this position, the butterfly 8 is manually rotated to effect rotation of the can by the gear 6 and cutting of the lid from the can by the cutter wheel 9. Upon the lid being cut free of the can it will not drop from the can opener into the contents of the can below, but it will be magnetically held to the magnet of the unit above. When the user subsequently decides to dispose of the cut lid, he will manually press the nub 24 of the lever downward, that is clockwise, to cause the magnet to rise in the cylinder 18 and carry the cut lid into abutment with the bottom end of the cylinder. The lid will then drop away from the magnet and the can opener as the magnet is caused to rise clear of the lid and further up into the cylinder to release its magnetic hold upon the lid.

While an embodiment of the invention has been illustrated and described in detail, it is to be expressly understood that the invention is not limited thereto. Various changes of form, design and arrangement may be made in its components without departing from the spirit and scope of the invention. It is my intent, therefore, to claim the invention not only as shown and described but also in all such forms and modifications thereof as may be reasonably construed to be within the spirit of the invention and the scope of the appended claims.

What is claimed is:

1. In a can opener, a unit for holding and releasing a lid cut by the can opener comprising: an arm fixed at a rear end thereof to a side face of a can opener, the arm having at a forward end thereof a depending open-ended cylinder positioned to overhang the lid of a can engaged by the can opener to be cut away, and a lever pivotally connected intermediately of its ends to the arm, the lever having at a forward end thereof a cylindrical magnet depending freely into the cylinder, the magnet projecting in part from a bottom of the cylinder in a counter-clockwise pivoted condition of the lever so as to seat upon and magnetically hold to it the lid of the can, and the lever having a rear extension that is manually actuable to pivot the lever clockwise to raise the magnet to bring its projecting part into the cylinder above and clear of the bottom end of the cylinder so as to release the hold of the magnet from the lid of the can.

2. A unit as in claim 1, wherein the unit, except for the magnet, is made of non-magnetic material.

3. A combination comprising a can opener and a unit for holding and releasing a lid cut by the can opener; the can opener having an upper handle pivoted at one end to a corresponding end of a lower handle, a cutter wheel mounted to a side face of the upper handle, a stub shaft rotatably supported by the lower handle and projecting through opposite side faces of the lower handle, a gear mounted below the cutter wheel upon one end of the stub shaft, a butterfly mounted on the opposite end of the stub shaft for being manually rotated to rotate the gear, the can opener being adapted to engage the lid of a can between the cutter wheel and the gear for cutting the lid away from the can as the can is rotated by the gear; and the unit mounted to the side face of the upper handle, the unit having an arm that includes a backpiece fixed at a rear end thereof to the side face of the upper handle, wherein the arm extends laterally away from the backpiece and has at its opposite end an open-ended cylinder for depending above the lid that is to be cut away from the can, and the unit including an upper lever having an ear intermediately of its ends, the ear being pivoted to the backpiece, the lever having a forward section extending from the ear laterally and above the arm, the forward section having at its outer end a magnet depending freely into the cylinder and projecting at its bottom from a bottom of the cylinder, the projecting bottom of the magnet adapted to seat upon and magnetically hold to it the lid of the can as the lid is being cut away, and the lever having a rear section extending from the ear, the rear section being manually actuable for pivoting the lever to raise the magnet into the cylinder so as to carry the lid after it has been cut away into abutment with the bottom of the cylinder and to cause the lid to be released from the hold of the magnet as the magnet is raised up into the cylinder clear of the lid.

4. The combination as in claim 3, wherein the unit, except for the magnet, is made of non-magnetic material.

5. In a can opener, a unit for holding and releasing a lid cut by the can opener comprising: a lower member having a backpiece at a rear end thereof and having at a forward end thereof a depending open-ended cylinder, a lever pivotally connected intermediately of its ends to the backpiece for pivoting of the lever relative to the lower member, the lever having at a forward end thereof a cylindrical magnet, the magnet depending freely into the open-ended cylinder and projecting in part from a bottom end of the cylinder, the lever being manually pivotable to raise the magnet to bring its projecting part up into the cylinder and above the bottom end of the cylinder, and the unit except for the magnet being made of non-magnetic material, wherein the backpiece of the lower member is fixed to a side face of a handle of a can opener at a point in which the open-ended cylinder is located above the lid of a can engaged by the can opener to be cut away and in which the projecting part of the magnet is seated upon the lid of the engaged can.

* * * * *